United States Patent [19]

Collins et al.

[11] Patent Number: 4,874,297

[45] Date of Patent: Oct. 17, 1989

[54] RADIAL PUMP

[76] Inventors: Arthur R. Collins, P.O. Box 57078, Oklahoma City, Okla. 73112; Carroll E. Clarkson, 9505 Ridgeview Dr., Oklahoma City, Okla. 73120

[21] Appl. No.: 286,182

[22] Filed: Dec. 19, 1988

[51] Int. Cl.[4] ..... F04B 1/04

[52] U.S. Cl. ..... 417/265; 417/266; 417/273; 91/495

[58] Field of Search ..... 417/265, 266, 273; 91/491, 494, 495; 123/55 AA

[56] References Cited

U.S. PATENT DOCUMENTS

| | | | |
|---|---|---|---|
| 3,294,316 | 12/1966 | Ellinger et al. | 417/273 X |
| 4,270,439 | 6/1981 | Ponchaux | 417/273 X |
| 4,313,714 | 2/1982 | Kubeczka | 417/473 |
| 4,583,920 | 4/1986 | Lindner | 417/266 |

FOREIGN PATENT DOCUMENTS

| | | | |
|---|---|---|---|
| 2116796 | 7/1972 | France | 417/265 |
| 204985 | 11/1983 | Japan | 417/273 |

*Primary Examiner*—Michael Koczo

[57] ABSTRACT

In a valveless pump, a pump body, having a central chamber, is provided with a radially disposed array of pistons movable toward and away from the axis of the pump body. Cylinder heads cooperate with the pistons in controlling fluid movement through the pump. A drive shaft extends axially into the pump chamber and includes a surrounding eccentric cam. A linkage assembly pivotally connects the inward end portions of the several pistons with a tether ring surrounding the drive shaft for maintaining the pistons in contact with the eccentric cam and reciprocating the pistons in sequence for moving fluid through conduits sequentially communicating with the several piston cylinders.

9 Claims, 2 Drawing Sheets

RADIAL PUMP

BACKGROUND OF THE INVENTION

1. Field of the Invention

The present invention relates to a fluid pump of the radial type and more particularly to a valveless radial pump.

There is currently a need for a fluid pump capable of moving highly viscous liquids without damaging the pump, for example, moving a concrete forming mixture of cement and aggregate from a mobile mixer to a remote location through a hose. Also, there is the problem of pump movement of a highly viscose polymer utilized as a flow enhancer in pipe lines. This polymer, when stressed in passing through the valves of conventional pumps, produced crystalline flakes extremely abrasive to known metals in pumping mechanisms and the polymer tended to carry debris, such as rocks, pipe scale, and welding slag, into the pumping unit and defied filtering efforts as a result of its density.

This invention provides a valveless pump capable of moving viscous fluids, such as those described above, without damage to the pump.

2. Description of the Prior Art

Radial pumps are well known, some of which have utilized pistons of varying diameter or a subpiston, which generates very high pressure fluid output, such as U.S. Pat. No. 4,313,714. This patent discloses a high pressure radial pump delivering a high velocity jet stream discharge for washing or cleaning achieved by a plurality of inlet and outlet valve equipped radially disposed cylinders interconnected by inlet and outlet fluid manifolds. Each piston includes a small diameter pump piston 25 moved by a larger diameter operating piston 65. One operating piston 65 is rigidly connected with a central ring pivotally connected with the remaining operating pistons. The pistons are reciprocated by an eccentric cam mounted on a drive shaft.

The principal distinction of the pump of this invention over prior patents, including the above named patent, is the elimination of intake and exhaust valves associated with each piston. Inlet and discharge fluid flow thorugh a single tubular flow path communicating with each cylinder is achieved by sequential piston head contact with a cylinder head partition in the fluid flow path at each cylinder.

SUMMARY OF THE INVENTION

A pump body is provided with a central chamber communicating with a plurality of circumferentially spaced radially disposed cylinder bores closed at their outer ends by a cylinder head having a transverse fluid flow path communicating with the respective cylinder and having a transverse partition in the flow path projecting axially toward the cylinder. The partition defines flow path inlet and outlet ports at each cylinder position when contacted by the adjacent end of the respective piston at the limit of its outward travel. A drive shaft, axially projecting into the pump chamber, is surrounded by a cam eccentric. A like plurality of pistons in the cylinders are pivotally connected by a link and roller assembly with a tether ring surrounding the drive shaft adjacent the cam which maintains the respective roller of the roller and link assembly in contact with the periphery of the cam eccentric and sequentially reciprocates the pistons as the drive shaft and cam are angularly rotated. Tubing means connect a source of fluid to the inlet of a selected cylinder head and the outlet of a terminal cylinder head of the radial array. Other conduits connect the remaining outlet ports and inlet ports together in sequence. Fluid flow through the pump body surrounding tubing and conduit members, in one direction, being achieved by the respective piston sequentially sealing with the respective cylinder head partition.

The principal object of this invention is to provide an economical valveless radial pump for pumping viscous fluids or fluid containing aggregate up to three eights ($\frac{3}{8}$) the inside diameter of its fluid conducting conduits.

DESCRIPTION OF THE PREFERRED EMBODIMENTS

Figure 1:
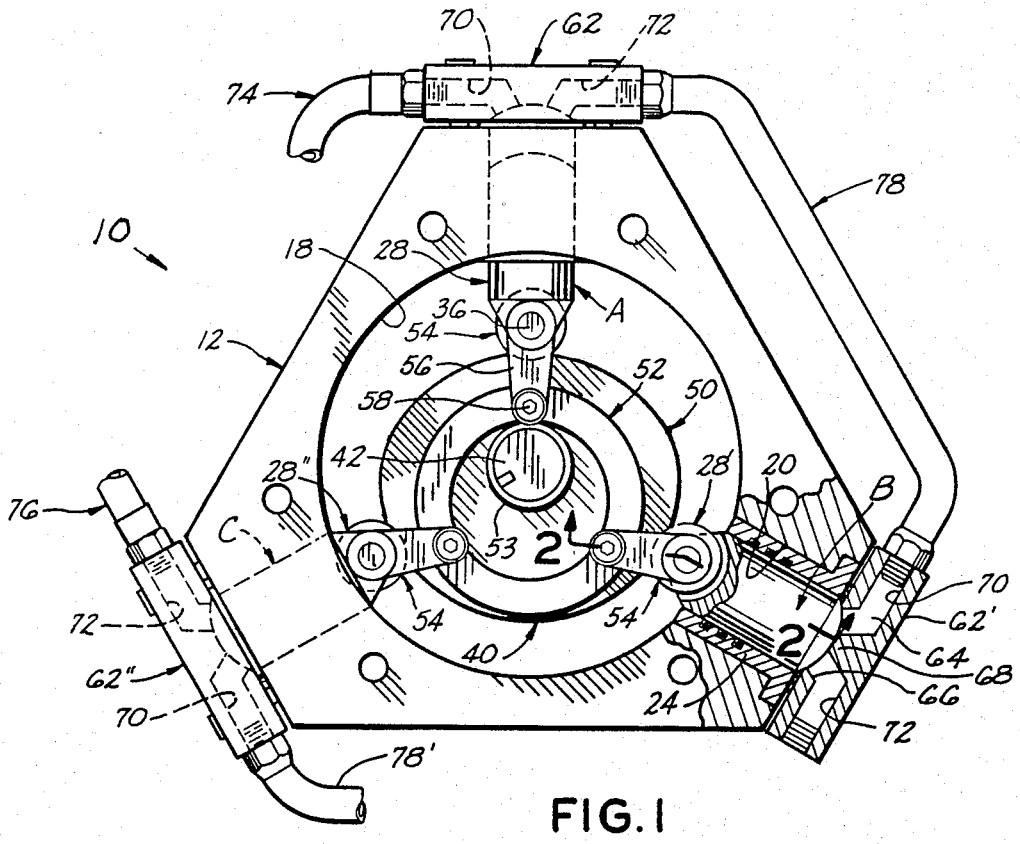
FIG. 1 is a fragmentary and elevational view of the pump, partially in section, with the adjacent end cover removed for clarity.

Like characters of reference designate like parts in those figures of the drawings in which they occur.

Figure 2:
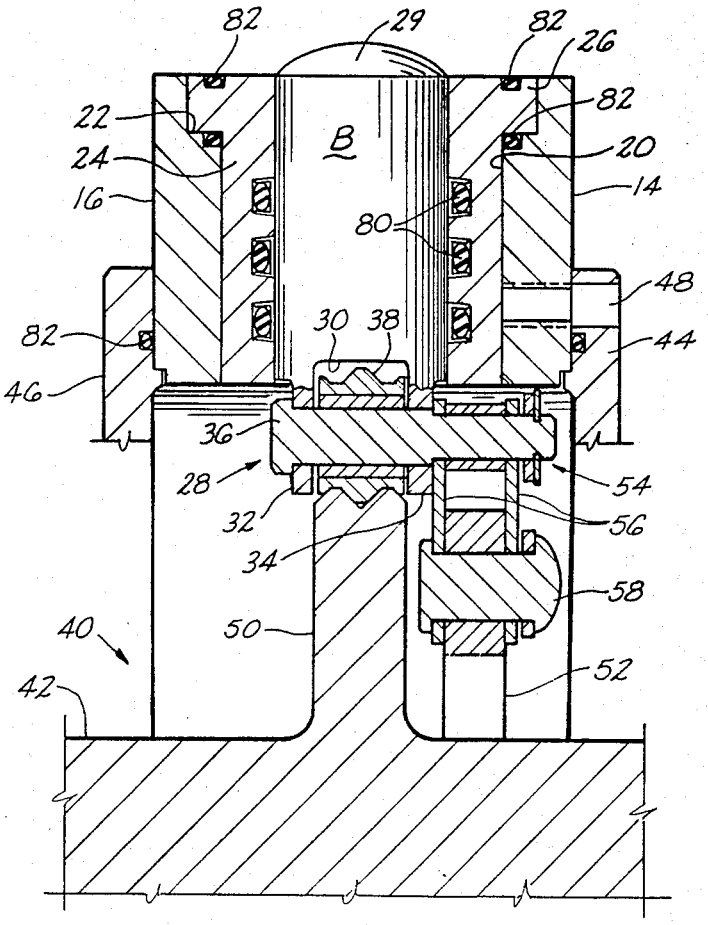
FIG. 2 is a fragmentary vertical cross sectional view, to an enlarged scle, taken substantially along the line 2—2 of FIG. 1 and rotated to dispose the piston upright; and, FIGS. 3, 4, 5, 6, 7 and 8 are views similar to FIG. 1, to a different scale, illustrating the sequence of pump component movement during one revolution of the pump drive shaft.

In the drawings:

Referring more particularly to FIGS. 1 and 2, the reference numeral 10 indicates one unit of the radial pump comprising a pump body 12 having opposite end surfaces 14 and 16 and a central chamber 18 extending axially between its end surfaces. The pump is further provided with a plurality, three in the example shown, of circumferentially equally spaced cylinder bores 20. Each of the cylinders is counterbored from its outer end to define an outwardly facing annular shoulder 22. Each of the cylinders receive a cylinder liner or sleeve 24 having an annular outstanding flange 26 nested by the cylinder counterbore for anchoring the sleeve as will be presently apparent.

Each of the cylinder liners contain pistons means 28, 28' and 28". The respective piston means includes pistons A, B and C. The outwardly disposed end of the piston B is covered by a part spherical piston cap 29 preferably of resilient material for the purposes presently explained.

Since the piston means 28 are identical, only the piston means 28' associated with the piston B, is described in detail in the interest of brevity. The inwardly disposed end of the piston B is bifurcated, as at 30, transversely of the body longitudinal axis, to form parallel piston legs 32 and 34 projecting beyond the inwardly disposed end limit of the piston sleeve 24 for the purposes believed readily apparent. These legs 32 and 34 are tranversely line drilled for receiving a piston pin 36 which projects, at one end portion, longitudinally of the valve body beyond the piston toward the plane of its end surface 14. A bearing journalled roller 38 surrounds the pin 36 between its legs 32 and 34.

Drive shaft means 40, including a drive shaft 42 driven by a prime mover, not shown, axially projects into the pump chamber 18 and is journalled by pump end plates 44 and 46, respectively, secured to the pump end surfaces by bolts 48. The drive shaft means 40 includes an integral cam eccentric 50 having its peripheral cam surface contacting the piston roller 38. The cam surface and piston roller preferably being cooperatively grooved to prevent lateral movement of the cam or roller relative to each other in a direction axially of the pump body.

A piston tether ring 52 loosely surrounds the drive shaft 42 between the eccentric cam and the pump end plate 44. A bearing 53 surrounds the drive shaft 42 to reduce friction between the tether ring and drive shaft. Link means 54 pivotally secures the piston pin 36 to the tether ring 52. The link means comprises a pair of parallel links 56 disposed on opposing surfaces of the tether ring and secured thereto by a pin or rivet 58 extending transversely through the tether ring and one end portion of the pair of tether links with the other end portion of the tether links pivotally surrounding the end portion of the piston pin 36 projecting toward the pump body end plate 44. The tether ring 52 may be replaced by an endless flexible strand extended between the links 56 over the pin 58.

Cylinder head means 52 overlies and is secured to the pump body in overlying relation with respect to the respective piston and its sleeve 24. Each of the cylinder head means 62 is identical and is characterized by a transverse fluid passageway forming bore 64 parallel with the transverse central plane of the pump body. The cylinder head means 62 further having an opening 66 in its wall facing the pump body providing communication between the bore 64 and the respective cylinder sleeve bore. The cylinder head means 62 further includes a partition 68 medially the length of its bore 64 which projects toward the axis of the piston from the outwardly disposed side of the cylinder head means and divides the cylinder head bore 64 to define an inlet port 70, at one end portion, and an opposite outlet or discharge port 72. The ports are respectively closed or opened by movement of the piston toward and away from the partition 68 when the pistons are reciprocated in the manner presently explained.

The inlet port 70, in a selected piston head of the radial array, is connected with tubular means 74 for supplying a source of fluid to be moved by the pump. The outlet port 72 of the terminal cylinder head of the radial array is similarly connected with tubular means 76 for discharging fluid moved by the pump. The respective outlet port 72 of the cylinder head 62 is connected wiith the inlet port 70 of the cylinder head means 62' by other conduit means 78 and similarly additional conduit means 78' connects the head means 62' outlet port 72 with the remaining inlet port 70 of the head means 62''.

Sleeve seal rings 80 seal with the piston wall while O-rings 82 form other fluid seals between joined components where desirable.

Operation

Referring more particularly to FIGS. 3–8 in sequence, the drive shaft means 40 is angular rotated in a clockwise direction and fluid flow through the tubing and conduit means is also in a clockwise direction, however, as will be presently apparent the drive shaft and flow direction may be reversed, if desired.

Figure 3:
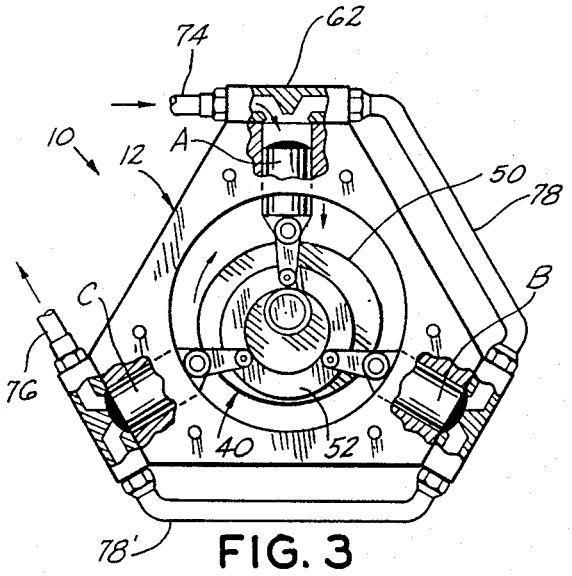

In FIG. 3, a piston A is on its inward or suction stroke thus drawing fluid from the fluid inlet tubing 74 into its cylinder. Piston B head is closed with its cylinder head partition 68 thus checking the flow between piston B and piston A. In each cycle of operation at least one of the piston heads is closed with its partition at all times.

Figure 4:
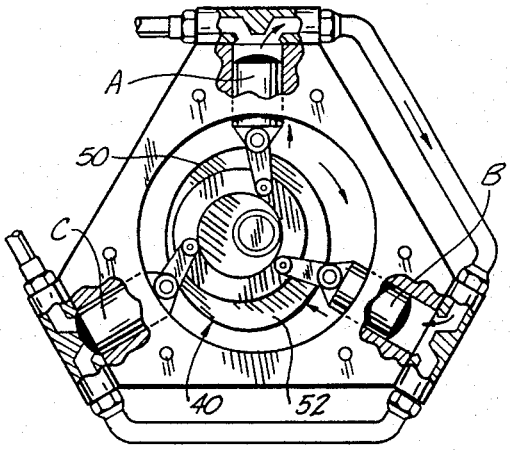

In FIG. 4, piston A is on its exhaust stroke while piston B is on its intake or suction stroke thus moving fluid in the direction of the arrow between pistons A and B. The head of piston C is closed with its partition.

Figure 5:
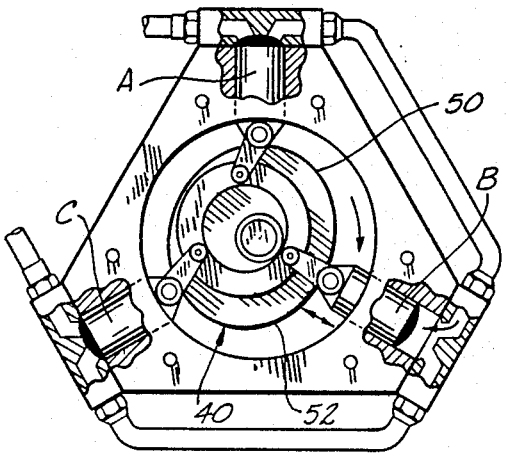

In FIG. 5, piston A has closed with its partition and piston C remains closed as piston B completes its inward movement in a direction of movement change.

Figure 6:
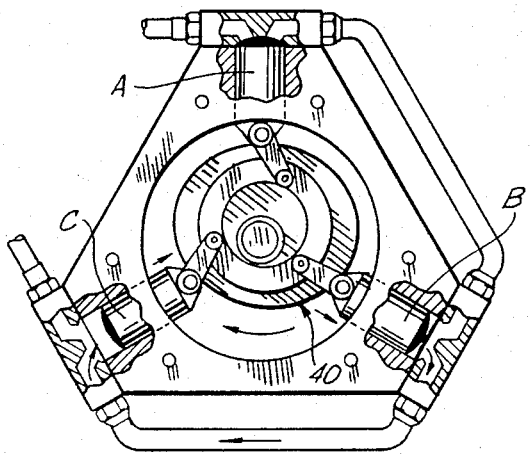

In FIG. 6, a piston A is still closed with its partition while piston B is discharging fluid into piston C while the latter is on its intake or suction stroke.

Figure 7:
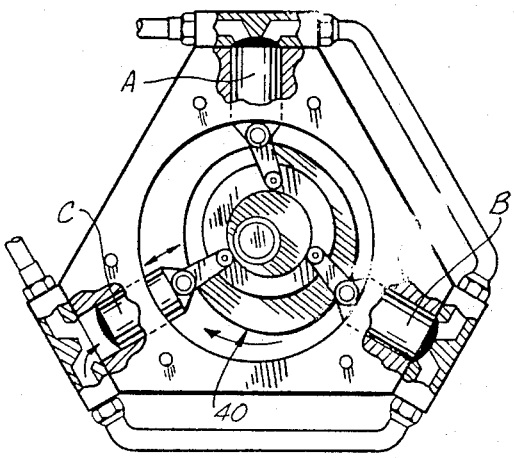

In FIG. 7, piston A is still closed just prior to beginning its intake stroke. Piston B has closed with its partition as piston C completes its intake or suction stroke.

Figure 8:
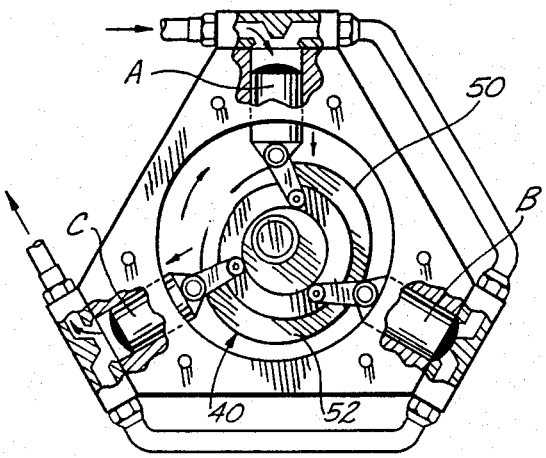

In FIG. 8, piston B is still closed with its partition while piston C is discharging fluid into the tubing 76 while piston A is again on its intake or suction stroke thus completing one cycle of operation.

Obviously, the piston head closing with the cylinder head partitions generates a pulsing action in the fluid flow which can be substantially eliminated by axially abutting other identical pump units with this pump unit 10 and joining the pump bodies 12 together, preferably eliminating the abutting end plates and angularly rotating the second pump unit 180° with respect to the position illustrated in the drawings so that the inlet hose, connected with the cylinder head 62 of piston A, is between the positions of piston B and C. The inlet hoses 74 and 76 of the respective units are joined in a conventional manner with a larger diameter fluid source and discharge conduit, neither being shown, through which the substantially steady fluid flow is conducted.

Obviously the invention is susceptible to changes or alterations without defeating its practicability. Therefore, we do not wish to be confined to the preferred embodiment shown in the drawings and described herein.

We claim:

1. A rotary pump, comprising:

pump body means having a central chamber and having a plurality of pump cylinders extending outwardly therefrom in a radial array;

a like plurality of pump pistons reciprocable in said pump cylinders;

a like plurality of cylinder head means overlying the outward end of said cylinder bores and forming a cylinder inlet port and a cylinder outlet port for pumping fluid therethrough;

first tubular means connecting a source of fluid with a selected cylinder head inlet port;

second tubular means connecting the cylinder head outlet port of the terminal cylinder head of the radial array;

conduit means extending between and connecting the remaining cylinder head outlet ports, in sequence, to the remaining cylinder head inlet ports of the radial array;

rotary drive means including a drive shaft axially extending into the pump chamber and having a surrounding cam eccentric rotatable therewith;

tether means surrounding an intermediate portion of the drive shaft adjacent the cam;

means extending between and pivotally connected at its respective end portions with the respective piston and said tether means for sequentially reciprocating said pistons in response to angular rotation of said cam eccentric; and, seal means on the outer end of the respective piston cooperating with the respective cylinder head means for closing said inlet port and said outlet port when the respective piston reaches the outer limit of its travel.

2. The rotary pump according to claim 1 in which the pivotally connected means includes:

link means; and, means joining said link means to the tether means and each said piston in a manner maintaining said pistons in contact with the adjacent peripheral portion of said cam eccentric.

3. The rotary pump according to claim 2 in which said tether means comprises:

a ring.

4. The rotary pump according to claim 3 and further including:

antifriction means interposed between the inward end portion of said pistons and the adjacent peripheral portion of said cam eccentric.

5. The rotary pump according to claim 4 in which the cylinder head means includes:

a like plurality of cylinder heads secured to said pump body, each said cylinder head having a transverse fluid passageway and having an opening medially the ends of the fluid passageway providing communication between the fluid passageway and the adjacent cylinder; and, a partition transverely dividing the cylinder head fluid passageway and cooperating with said piston seal means for closing said inlet and outlet ports.

6. The rotary pump according to claim 1 in which the inwardly disposed end portion of said pistons is bifurcated and said pivotally connected means means includes:

antifriction means secured in the bifurcated end portion of each said piston;

a link; and, pin means joining said link to the tether means and said piston bifurcated end portion in a manner maintaining said antifriction means in contact with the adjacent peripheral portion of said cam eccentric.

7. The rotary pump according to claim 2 in which said tether means comprises:

a ring.

8. The rotary pump according to claim 7 in which the antifriction means comprises:

a roller.

9. The rotary pump according to claim 2 in which the cylinder head means includes:

a like plurality of cylinder heads secured to said pump body, each said cylinder head having a transverse fluid passageway and having an opening medially the ends of the fluid passageway providing communication between the fluid passageway and the adjacent cylinder; and, a partition transversely dividing the cylinder head fluid passageway and cooperating with said piston seal means for closing said inlet and outlet ports.

* * * * *